US005974280A

United States Patent [19]

Takesue et al.

[11] Patent Number: 5,974,280

[45] Date of Patent: Oct. 26, 1999

[54] IMAGE FORMING APPARATUS HAVING A TONER CONCENTRATION CONTROLLING MECHANISM BASED ON A CLOCKED TIME PERIOD FOR THE RECOVERY

[75] Inventors: Yuichiro Takesue, Ikoma; Yoshiaki Akazawa, Osaka; Tadashi Nakamura, Nara; Toshihiko Murakami, Kashiba; Junichi Saito, Soraku-gun; Tadayuki Sawai, Yamatokoriyama, all of Japan

[73] Assignee: Sharp Kabushiki Kaisha, Osaka, Japan

[21] Appl. No.: 09/097,232

[22] Filed: Jun. 12, 1998

[30] Foreign Application Priority Data

Jun. 13, 1997 [JP] Japan ..... 9-156384

[51] Int. Cl.[6] ..... G03G 15/00

[52] U.S. Cl. ..... 399/62; 399/43; 399/46

[58] Field of Search ..... 399/30, 43, 46, 399/51, 53, 55, 58, 61, 62

[56] References Cited

U.S. PATENT DOCUMENTS

| | | | |
|---|---|---|---|
| 4,734,737 | 3/1988 | Koichi | 399/58 |
| 4,947,473 | 8/1990 | Kinashi | 399/53 |
| 4,985,823 | 1/1991 | Tada et al. | 399/62 X |
| 5,310,423 | 5/1994 | Aimoto et al. | 399/62 X |
| 5,839,018 | 11/1998 | Asanuma et al. | 399/43 |

FOREIGN PATENT DOCUMENTS

| | | |
|---|---|---|
| 4-50 880 | 2/1992 | Japan . |
| 4-110 977 | 4/1992 | Japan . |
| 4-213 472 | 8/1992 | Japan . |
| 6-289715 | 10/1994 | Japan . |

*Primary Examiner*—Matthew S. Smith
*Assistant Examiner*—Sophia S. Chen
*Attorney, Agent, or Firm*—David G. Conlin; William J. Daley, Jr.

[57] ABSTRACT

An image forming device includes an optical system for forming an electrostatic latent image on a photosensitive body by exposure of an original in light, a development system for developing the electrostatic latent image, and a control system for controlling the optical system and the development system. The control system detects the concentration of a toner in a developing agent tank, calculating a difference between the detected toner concentration and a predetermined toner concentration, replenishing the toner to the developing agent tank until the detected toner concentration makes a recovery to the predetermined toner concentration, clocking a time period for the recovery and controlling at least one of the amount of the exposure light and the amount of the toner adhering to a photosensitive body based on the clocked time period for the recovery.

7 Claims, 11 Drawing Sheets

IMAGE FORMING APPARATUS HAVING A TONER CONCENTRATION CONTROLLING MECHANISM BASED ON A CLOCKED TIME PERIOD FOR THE RECOVERY

BACKGROUND OF THE INVENTION

1. Field of the Invention

The present invention relates to an image forming device, particularly to an image forming device using an electrophotography system which is applied to a copier, a laser printer, a facsimile and the like and in which a two components developing agent comprising a toner and a carrier is used.

2. Description of the Related Art

An image forming device for carrying out image formation by using an electrophotography system is installed with devices which are liable to undergo influence of environmental change and ageing change such as a photosensitive body, a charging device, an exposing device, a developing device and so on. Therefore, an image forming state produced by the image forming device using the electrophotocopy system is varied by temperature, humidity, total number of image formations and the like, so that it is difficult to stably obtain a uniform image forming state.

Hence, according to conventional image forming devices, various image stabilization functions are provided to achieve stabilization of image by controlling process conditions of a charge amount, an exposure amount, developing bias, a toner concentration and so on. For example, in Japanese Patent Unexamined Publication No. JP-A-4-50880, there is disclosed a constitution in which in an image forming device for carrying out image formation by using a two components developing agent, humidity detecting means for detecting an environmental humidity and operating time detecting means for detecting operating time of at developing agent are installed, and when the environmental humidity is increased or the operating time of the developing agent is prolonged, lowering of a charge amount of a toner caused by an increase in the environmental humidity or prolongation of the operating time of the developing agent is prevented by lowering the concentration of the toner in a developing device.

Further, in Japanese Patent Unexamined Publication No. JP-A-4-110977, there are disclosed a constitution in which in order to prevent deterioration in image quality that is caused when a toner is liable to scatter owing to forced replenishment of the toner carried out under a copying forbidden state, the rotational speed of a replenishing roller in case of the forced replenishment of the toner under the copying forbidden state is retarded compared with the rotational speed of the replenishing roller in case of supplying the toner normally, and a constitution in which an interval between the replenishing roller and a scrape member in case of replenishing the toner under the copying forbidden state is made wider than the interval between the replenishing roller and the scrape member in case of replenishing the toner normally.

Furthermore, in Japanese Patent Unexamined Publication No. JP-A-4-213472, there is disclosed a constitution in which when a control value of the concentration of a toner is varied, developing bias voltage and an amount of exposure are changed such that a concentration of an original and a concentration of an image correspond to each other, thereby promoting response performance between control of the toner concentration and control of the image concentration and providing an image having excellent reproducibility and causing no stain in respect of all of the concentrations.

However, although in the image forming device using the two components developing agent the excellency or nonexcellency of the image forming state is influenced also by fluidity, charging performance and the like of a toner in a developing tank, there has been no conventional image forming device in which changes in the fluidity, the charging performance and the like of the toner are detected and appropriate image forming process conditions are controlled. Therefore, there have been cases where image formation is carried out under a state in which inappropriate process conditions are set, and there has been a problem of deteriorating the image forming state.

SUMMARY OF THE INVENTION

According to one aspect of the present invention, there is provided an image forming device for forming an image on a medium, comprising an optical system for forming an electrostatic latent image on a photosensitive body by exposure an original in light, a development system for developing the electrostatic latent image, and a control system for controlling the optical system and the development system.

The development system includes a developing agent tank for storing a two components developing agent comprising a toner and a carrier, a replenishing unit for replenishing the toner to the developing agent tank, an agitating unit for mixing the two components developing agent in the developing agent tank and a developer for permitting the toner included in the developing agent in the developing agent tank to adhere to the photosensitive body.

The control system includes a detecting unit for detecting a concentration of the toner in the developing agent tank, a storing unit for storing a predetermined toner concentration, an operation processing unit for calculating a difference between the detected concentration and the predetermined toner concentration and for operating the replenishing unit until the detected concentration makes a recovery to the predetermined toner concentration when the detected concentration becomes smaller than the predetermined toner concentration, a clocking unit for clocking a time period for the recovery and a control unit for controlling a state of the formed image by adjusting at least one of the amount of the light exposing the original and the amount of the toner adhering to the photosensitive body based on the clocked time period for the recovery.

DETAILED DESCRIPTION OF PREFERRED EMBODIMENTS

Figure 1:
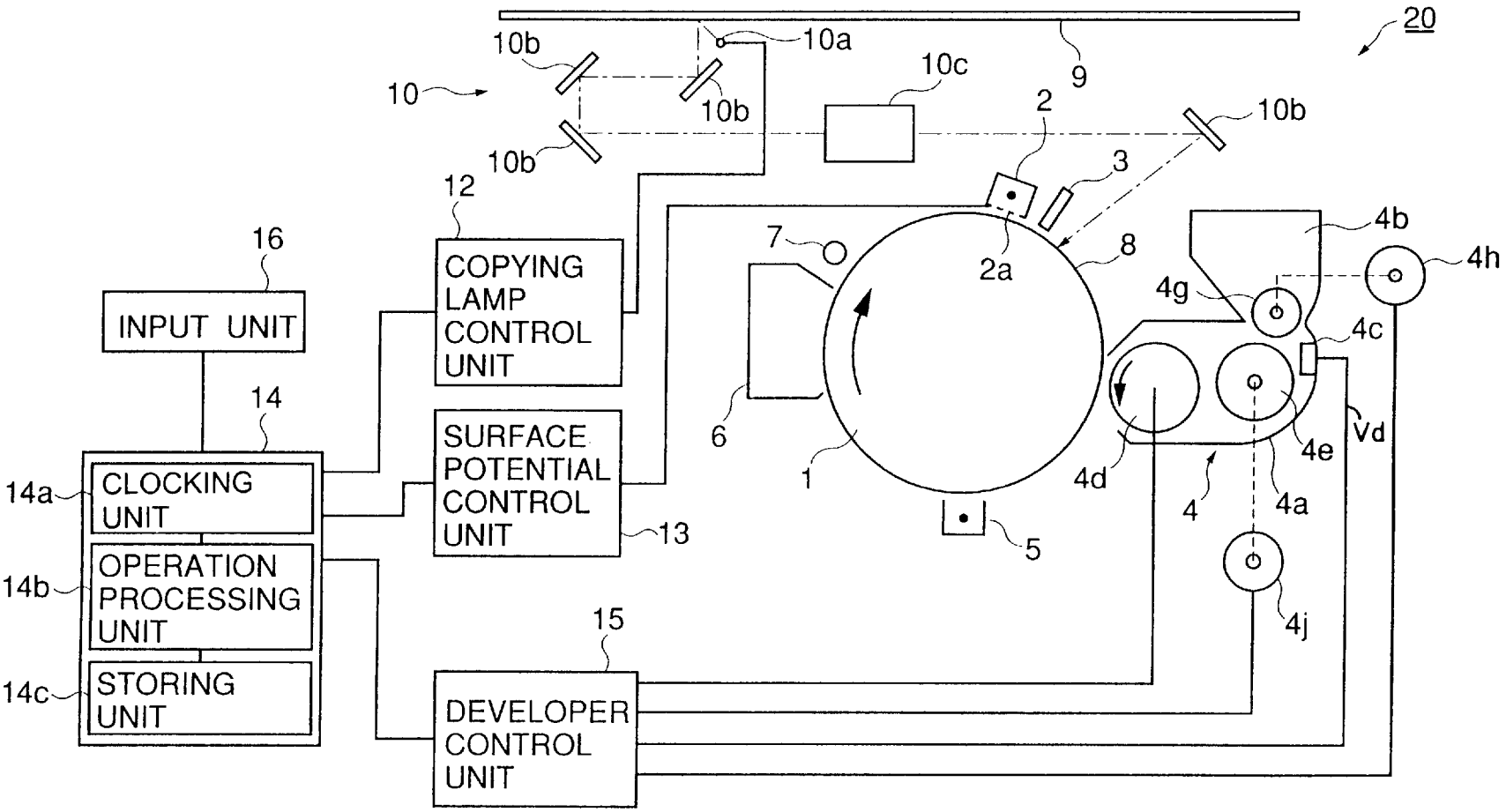
FIG. 1 is a schematic view showing a constitution of an image forming device according to an embodiment of the present invention.

The two components developing agent in the present invention means an agent in which a toner is mixed with a carrier at a rate of, for example, 5–20 weight percent. In respect of the toner, for example, there can be used fine powders including about 90 weight percent of a thermoplastic resin such as styrene resin, acrylic resin or epoxy resin, 6–8 weight percent of carbon black and about 2 weight percent of a charge controlling agent and having a diameter of 5–20 $\mu$m and a melting point of 80–120° C.

The carrier is a granular substance which is used as a medium of the toner for adhering the toner to a latent image charge uniformly. For example, iron powder having a diameter of 50–200 $\mu$m and coated with a thin aluminum oxide layer or an aluminum layer is used as the carrier.

Incidentally, the carrier needs not to be replenished continuously since it is not consumed in an image forming process differently from the toner.

When the carrier and the toner are mixed and agitated, they are charged in polarities reverse to each other by friction charging and a number of toner particles adhere to the surface of one carrier particle. Since electric charge of the electrostatic latent image on the photosensitive body and electric charge of the toner are provided with polarities reverse to each other, by bringing the carrier into contact with the photosensitive body, the toner on the surface of the carrier is attracted to the electric charge of the latent image and adhered to the latent image, so that the latent image is developed and converted into a toner image. Accordingly, the charge state of the toner influences on development of the latent image.

According to the optical system in the present invention, the electrostatic latent image is formed on the photosensitive body by exposing the original and the optical system can be constituted by an base for mounting the original, a lamp for exposing the original with light, a lens and a plurality of mirrors for guiding light from the original to the photosensitive body and so on.

Here, it is preferable that the amount of the exposure light can be controlled by changing a voltage applied to the lamp.

Further, the developing system is for developing the electrostatic latent image on the photosensitive body and is constituted by a developing agent tank for storing the two components developing agent, a replenishing unit for replenishing the toner to the developing agent tank, an agitating unit for agitating the two components developing agent stored, a detecting unit for detecting the concentration of the toner of the two components developing agent in the developing agent tank, a developer for making the toner including the developing agent adhere to the photosensitive body and so forth.

Here, the replenishing unit is provided with a hopper installed above the developing agent tank in order to store the toner, a toner replenishing roller installed rotably between the hopper and the developing agent tank in order to replenish the toner from the hopper to the developing agent tank, a replenishing motor for driving the toner replenishing roller and so forth, and it is preferable for the replenishing unit that a rate of replenishing the toner is changed in proportion to the rotational speed of the replenishing motor.

Further, the agitating unit is constituted by an agitating roller installed in the developing agent tank, a motor for driving the agitating roller and so forth, and it is preferable that an agitating speed is changed in proportion to the rotational speed of the motor.

A magnetic permeability sensor (for example, made by TDK Co., Ltd. or Hitachi Metals Co., Ltd.) can be used for the detecting unit for detecting the concentration of the toner in the developing agent since the magnetic permeability of the developing agent is changed in accordance with the content of the carrier. In this case, there is established a relationship where the higher the magnetic permeability is the lower is the toner concentration and the lower the magnetic permeability is the higher is the toner concentration.

Further, the developer is provided with a developing roller for making the toner adhere to the photosensitive body, and it is preferable that the amount of the toner adhering to the photosensitive body can be adjusted in accordance with a change in bias voltage applied to the developing roller.

The control system is provided with a control unit including an operation processing unit, a clocking unit, a storing unit and so forth for controlling the optical system and the developing system based on the concentration of the toner detected by the detecting unit, and the control unit can be constituted integrally by using a microcomputer including CPU, ROM, RAM and the like.

In the present invention, the control system can carry out selectively a plurality of control modes.

According to one mode, when the concentration of the toner becomes lower than a predetermined toner concentration, the toner is replenished until the toner concentration makes a recovery to the predetermined toner concentration, and at least either of the amount of the light exposing the original and the amount of the toner adhering to the photosensitive body is adjusted based on a time period required for the recovery, thereby controlling an image forming state.

According to another mode, when the concentration of toner becomes lower than a predetermined toner concentration, the toner is replenished, and at least either of the toner replenishing rate and the agitating speed is controlled until the toner concentration recovers to the predetermined toner concentration based on a time period for which the toner concentration recovers to an intermediate toner concentration that is lower than the predetermined toner concentration.

Further, according to still other mode, when the toner concentration becomes lower than a predetermined toner concentration, the toner is replenished until the toner concentration recovers to the predetermined toner concentration, and agitating motion is continued further for a time period corresponding to the recovery time.

In the present invention, the operation can be carried out also by combining at least two of the plural control modes mentioned above.

(Embodiments)

FIG. 1 is a schematic view showing a schematic constitution of an image forming device according to an embodiment of the present invention. An original base 9 comprising a hard glass body is arranged in the upper portion of an image forming device 20, and a copying lamp 10*a*, a plurality of mirrors 10*b* and a lens 10*c* constituting an optical system 10 are arranged below the original base 9. The copying lamp 10*a* and a part of the mirrors 10*b* scan an image of an original mounted on the original base 9 by horizontally reciprocating below a lower face of the original base 9.

A photosensitive drum 1 whose surface is constituted by a photoconductive material and which rotates in an arrow mark direction is installed at a substantially central portion of the image forming device 20. An electrifying charger 2, a blank lamp 3, a developer 4, a transcribing charger 5, a cleaner 6 and an electricity removing lamp 7 are arranged around the photosensitive drum 1 opposedly to the peripheral face of the photosensitive drum 1. Sheets are transferred sheet by sheet via a transfer path (not shown) between the photosensitive drum 1 and the transcribing charger 5.

After mounting the original on the original base 9, when start of an image forming process is instructed at an input unit 16, the copying lamp 10*a* and a part of the mirrors 10*b* in the optical system 10 are horizontally moved below the lower face of the original base 9, and the image face of the original is scanned by the copying lamp 10*a*. Light of the copying lamp 10*a* which is reflected by the developing image face is guided onto the surface of the photosensitive drum 1 via the mirrors 10*b* and the lens 10*c*.

Prior to the irradiation of the reflected light from the original, on the surface of the photosensitive drum 1, electric charge of a single polarity is uniformly electrified by the electrifying charger 2, and an electrostatic latent image is formed on the surface of the photosensitive drum 1 by a photoconductive action caused by the irradiation of the reflected light from the original. A toner is supplied from the developer 4 onto the surface of the photosensitive drum 1 formed with the electrostatic latent image, and the electrostatic latent image is visualized into a developing agent image.

A sheet is fed from a sheet feeding unit (not shown) in synchronism with rotation of the photosensitive drum 1 and the surface of the sheet is opposed to the developing agent image carried on the surface of the photosensitive drum 1 between the photosensitive drum 1 and the electrifying charger 5, and the developing agent image is transcribed onto the surface of the sheet by corona discharge of the transcribing charger 5. The sheet transcribed with the developing agent image is heated and pressed after having been introduced to a fixing device (not shown) and the developing agent image is melted and fixed onto the surface of the sheet.

Meanwhile, the surface of the photosensitive drum 1 which has passed through the position opposed to the transcribing charger 5 is removed of remaining developing agent by the cleaner 6 and further removed of remaining electric charge by the electricity removing lamp 7 and thereafter charged by the electrifying charger 2, thereby repeatedly carrying out the image forming process described above.

A control unit 14 is provided with a clocking unit 14*a*, an operation processing unit 14*b* and a storing unit 14*c*, and the control unit 14 is connected with an input unit 16, a copying lamp control unit 12, a surface potential control unit 13 and a developer control unit 15. The control unit 14 is constituted by a microcomputer including CPU, ROM, RAM and so forth, and the input unit 16 is constituted by a keyboard. The copying lamp control unit 12 applies drive voltage to the copying lamp 10*a* based on drive data supplied from the control unit 14. The surface potential control unit 13 adjusts charge potential at the surface of the photosensitive drum 1 by controlling grid voltage applied to a grid 2*a* installed in the electrifying charger 2 of a scolotron system based on the drive data supplied from the control unit 14. The developer control unit 15 detects the concentration of the toner in the developing agent within the developer 4 via a toner concentration sensor (hereinafter, referred to as ATC sensor) 4*c* installed in the developer 4, inputs a result of this detection to the control unit 14 and carries out rotational control of a toner replenishing motor 4*h* and an agitating motor 4*j* and control of development bias voltage applied to a developing roller 4*d* based on the control data supplied from the control unit 14.

A magnetic permeability sensor is used as the ATC sensor 4*c*. Therefore, by an increase or a decrease in the concentration of a nonmagnetic toner in respect of the magnetic carrier within the developing tank 4*a*, an output Vd of the ATC sensor 4*c* is decreased or increased conversely. By driving the toner replenishing motor 4*h* on the basis of the output detected by the ATC sensor 4*c*, the toner stored in a toner hopper 4*b* is replenished into a developing agent tank 4*a* and the concentration of the toner within the developing agent tank 4*a* is controlled.

Further, by controlling the developing bias voltage based on the concentration of the toner detected by the ATC sensor 4*c*, an amount of the toner flying from the surface of a developing roller 4*d* to the surface of the photosensitive drum 1 is adjusted by a potential difference between the surfaces of the developing roller 4*d* and the photosensitive drum 1. The concentration of the developing agent image formed on the surface of the photosensitive drum 1 is maintained constant by uniformizing the concentration of the toner within the developing agent tank 4*a* and by controlling the developing bias voltage.

Figure 2:
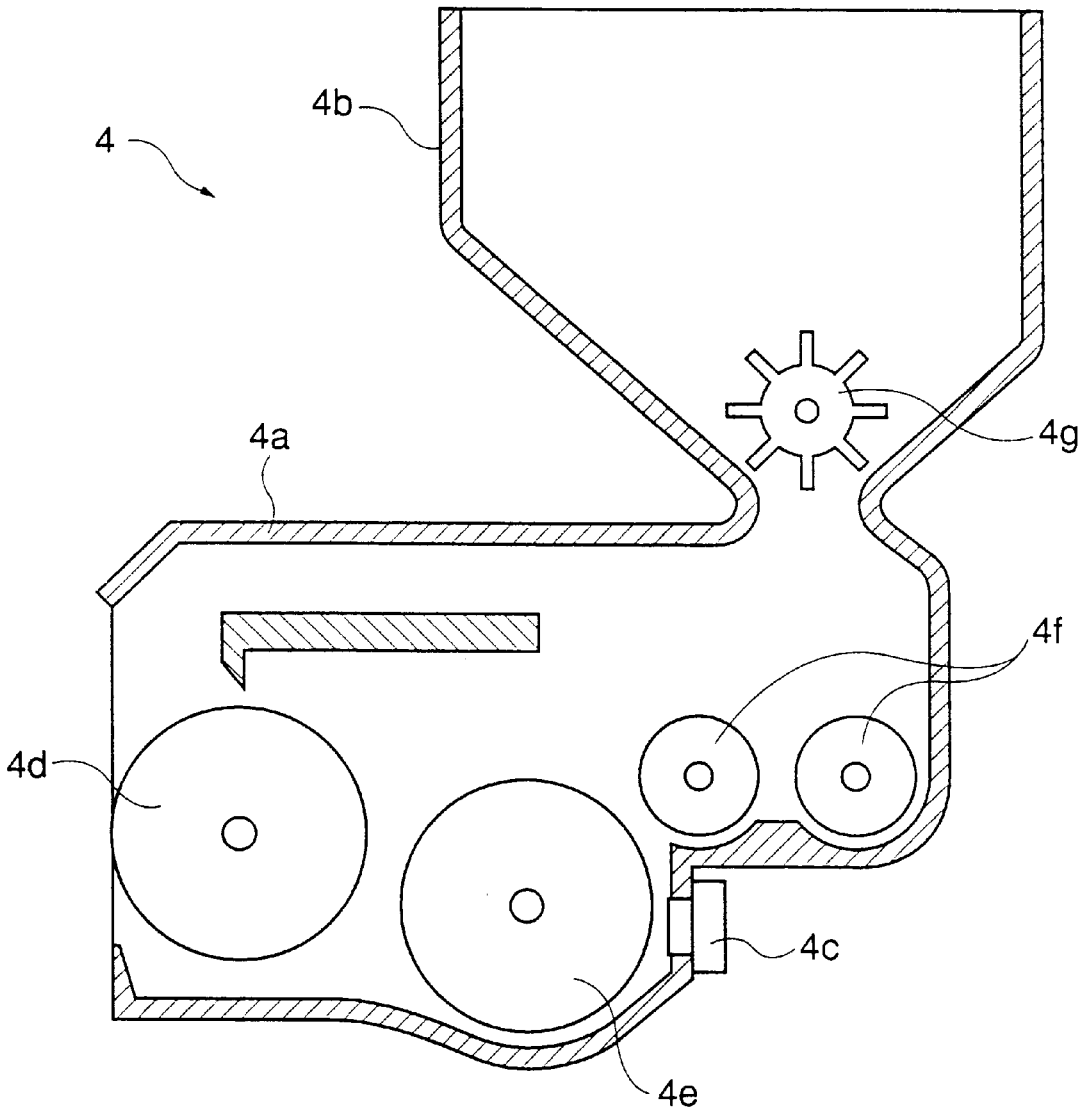
FIG. 2 is a view showing a constitution of a developer of the image forming device shown in FIG. 1.

FIG. 2 is a view showing the constitution of the developer 4 installed in the image forming device mentioned above. The developer 4 for supplying the developing agent onto the surface of the photosensitive drum 1 is constituted by the developing agent tank 4*a* and the toner hopper 4*b*. Within the developing agent tank 4*a*, there are axially supported the developing roller 4*d* opposed to the peripheral face of the photosensitive drum 1, an agitating roller 4*e* for agitating the two components developing agent comprising the toner and the carrier and transfer screws 4*f* for transferring the toner replenished from the toner hopper 4*b* to the agitating roller 4*e*. The toner and the carrier are agitated by rotation of the agitating roller 4*e* and are charged in reverse polarities to each other by friction. Further, the ATC sensor 4*c* described above is installed to the developing agent tank 4*a*. Atoner replenishing roller 4*g* is axially supported at the bottom portion of the toner hopper 4*d*. The toner replenishing roller 4*g* is driven to rotate by the toner replenishing motor 4*h* and replenishes the toner stored in the toner hopper 4*b* to the developing agent tank 4*a*.

An explanation will be given of the operation in such a constitution in accordance with the following four modes. Incidentally, either one of the four modes is selected by the input unit 16.

(First mode)

Figure 3:
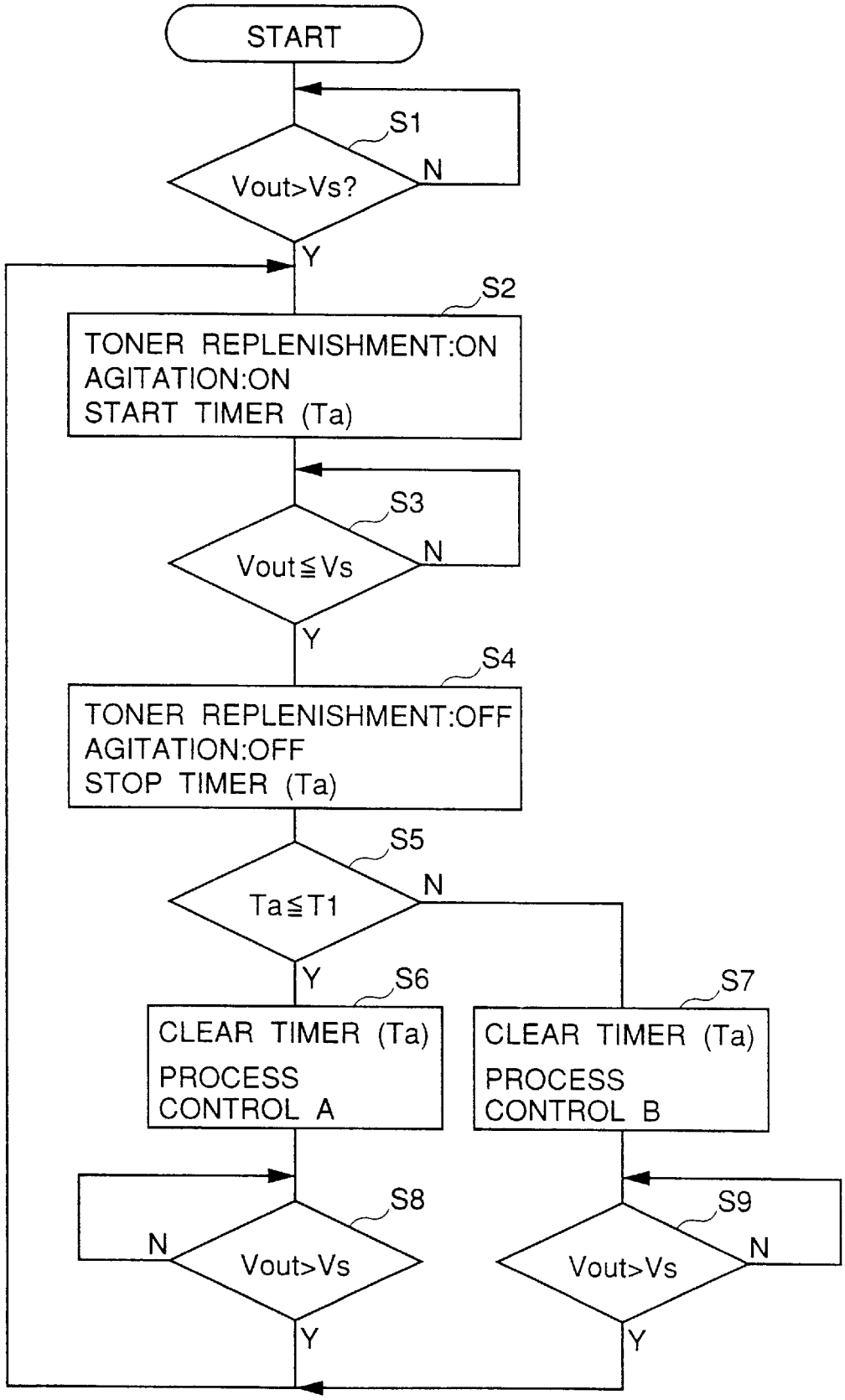
FIG. 3 is a flow chart showing a processing procedure in respect of a first mode of the present invention.

FIG. 3 is a flow chart showing a processing procedure when replenishing the toner according to a first mode of the present invention. The operation processing unit 14*b* compares an output Vout from the ATC sensor 4*c* with a reference value Vs stored in the storing unit 14*c* in carrying out an image forming process (s1) and starts replenishing the toner by driving the toner replenishing motor 4*h* and the agitating motor 4*j* when the output Vout from the ATC sensor 4*c* is higher than the reference value Vs, that is, when the concentration of the toner is lower than a predetermined concentration (s2).

At this time, the clocking unit 14*a* starts a built-in timer for clocking a toner replenishing time period Ta (s2). The operation processing unit 14*b* compares the output Vout from the ATC sensor 4*c* even during replenishing the toner (s3) and continues supplying the toner until the output Vout from the ATC sensor 4*c* becomes equal to or lower than the reference value Vs, that is, until the toner concentration becomes equal to or higher than the predetermined concentration.

When the output Vout from the ATC sensor 4*c* becomes equal to or lower than the reference value Vs during replenishing the toner, the operation processing unit 14*b* stops driving the toner replenishing motor 4*h* and the agitating motor 4*j* and stops the timer from clocking the toner replenishing time period Ta (s4). Next, the operation processing unit 14*b* compares the toner replenishing time period Ta clocked by the timer with a reference time period T1 stored in the storing unit 14*c* (s5), clears the timer when the toner replenishing time period Ta is equal to or shorter than the reference time period T1 and carries out process control A (s6), and the operation processing unit 14*b* clears the timer when the toner replenishing time period Ta exceeds the reference time period T1 and thereafter carries out process control B (s7). When Vout>Vs, step S2 is carried out again (s8, S9).

When the toner replenishing time period Ta is equal to or shorter than the reference time period T1 at step S5, that is, when a time period required for the concentration of the toner in the developing agent tank 4*a* to reach the reference value is short, since the fluidity of the toner is high and a time period for agitating the toner along with the carrier is also short, the toner is not charged with sufficient potential and fogging of image is liable to occur. Further, when the toner replenishing time period Ta exceeds the reference time period T1 and the time period required for the concentration of the toner in the developing agent tank 4*a* to reach the reference value is long, the fluidity of the toner is low owing to coagulation, solidification or the like of the developing agent, the toner is excessively replenished, the toner is not charged with sufficient potential and fogging of image is liable to occur.

Figure 4A:
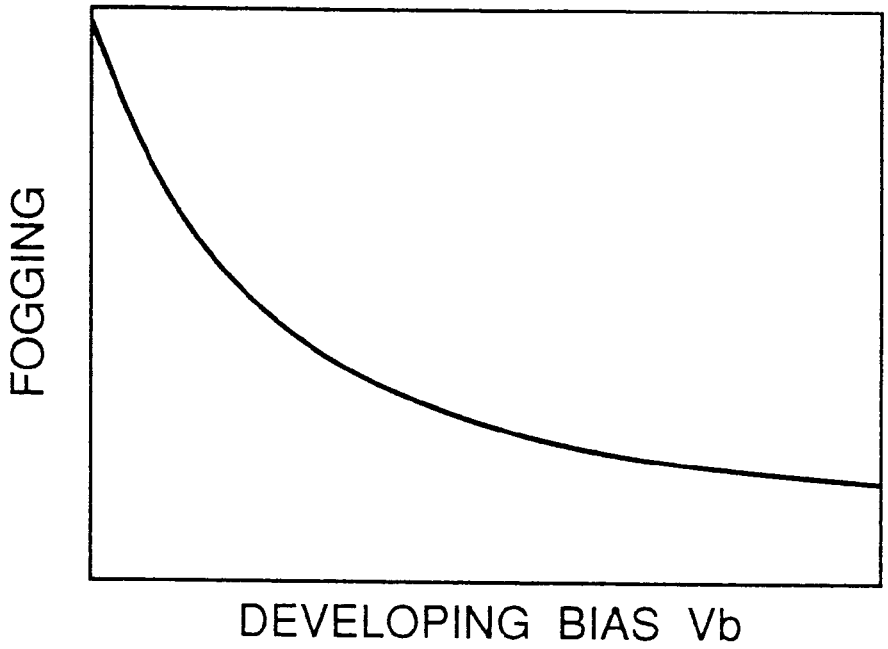
FIGS. 4(A) and 4(B) are diagrams for explaining the content of process control according to the first mode.
Figure 4B:
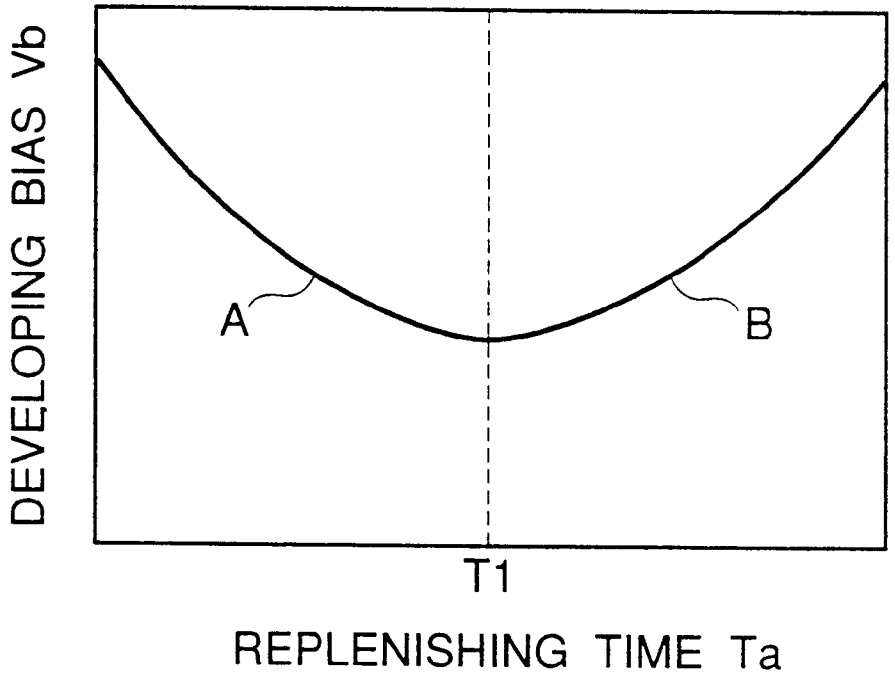

Hence, on the basis of a relationship between the developing bias voltage Vb and fogging of image shown in FIG. 4(A), as shown in FIG. 4(B) either of the process control A and the process control B, in which control states of the developing bias voltage Vb in the control processes are different from each other in accordance with whether the time period Ta for replenishing the toner is long or short, is carried out. That is, when the toner replenishing time Ta is equal to or shorter than the reference time period T1, the process control A in which the developing bias voltage Vb is increased in accordance with a decrease in the toner replenishing time period Ta is carried out, and when the toner replenishing time period Ta exceeds the reference time period T1, the process control B in which the developing bias voltage Vb is increased in accordance with an increase in the toner replenishing time period Ta is carried out.

Figure 5A:
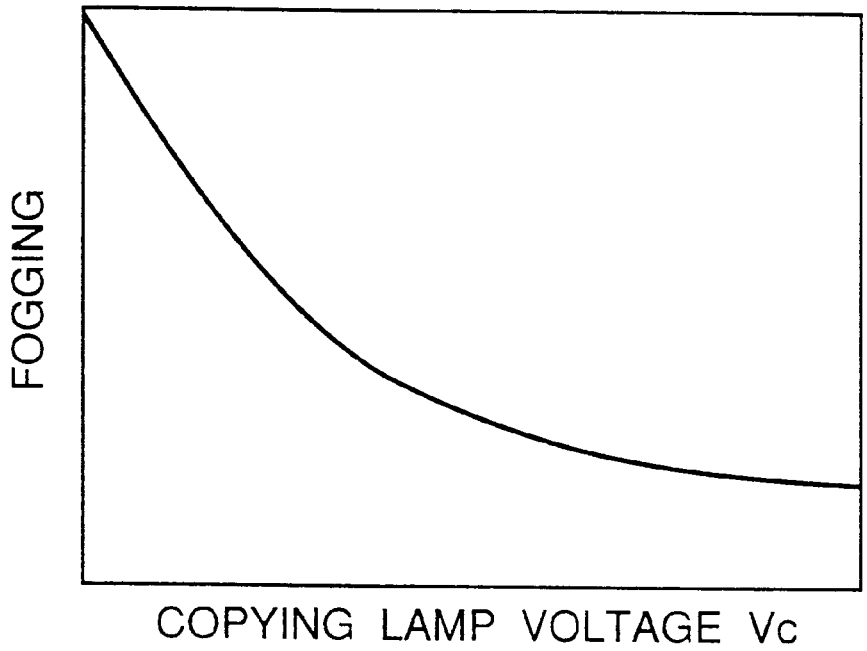
FIGS. 5(A) and 5(B) are diagrams for explaining the content of other process control according to the first mode.
Figure 5B:
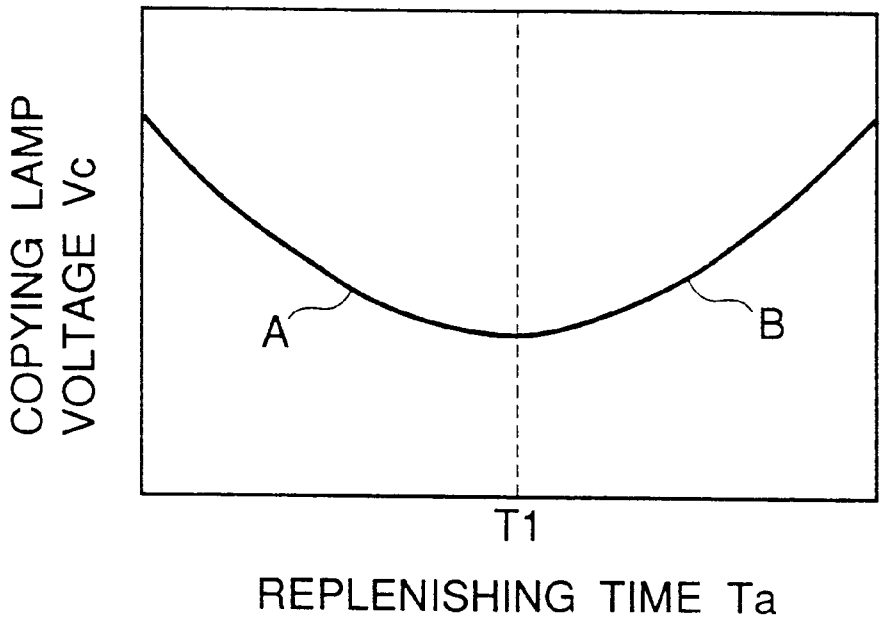

In this way, fogging of image can be prevented and an excellent image forming state can always be maintained by setting the developing bias voltage Vb in accordance with the fluidity of the toner when replenishing the toner. Further, in place of controlling the developing bias voltage Vb, on the basis of a relationship between the copying lamp voltage Vc and foging of image shown in FIG. 5(A), as shown in FIG. 5(B) the process control A and the process control B, in which control states of a copying lamp voltage Vc are different from each other, can be also carried out in accordance with whether the toner replenishing time period Ta is long or short. That is, when the toner replenishing time period Ta is equal to or shorter than the reference time period T1, the process control A in which the copying lamp voltage Vc is increased in accordance with a decrease in the toner replenishing time period Ta is carried out, and when the toner replenishing time period Ta exceeds the reference time period T1, the process control B in which the copying lamp voltage Vc is increased in accordance with an increase in the toner replenishing time period Ta is carried out. In this way, fogging of image can be prevented and excellent image forming state can always be maintained by setting the copying lamp voltage Vc in accordance with the fluidity of the toner when replenishing the toner. Further, the control of the developing bias voltage Vb and the control of copying lamp voltage Vc may be carried out simultaneously.

(Second Mode)

Figure 6:
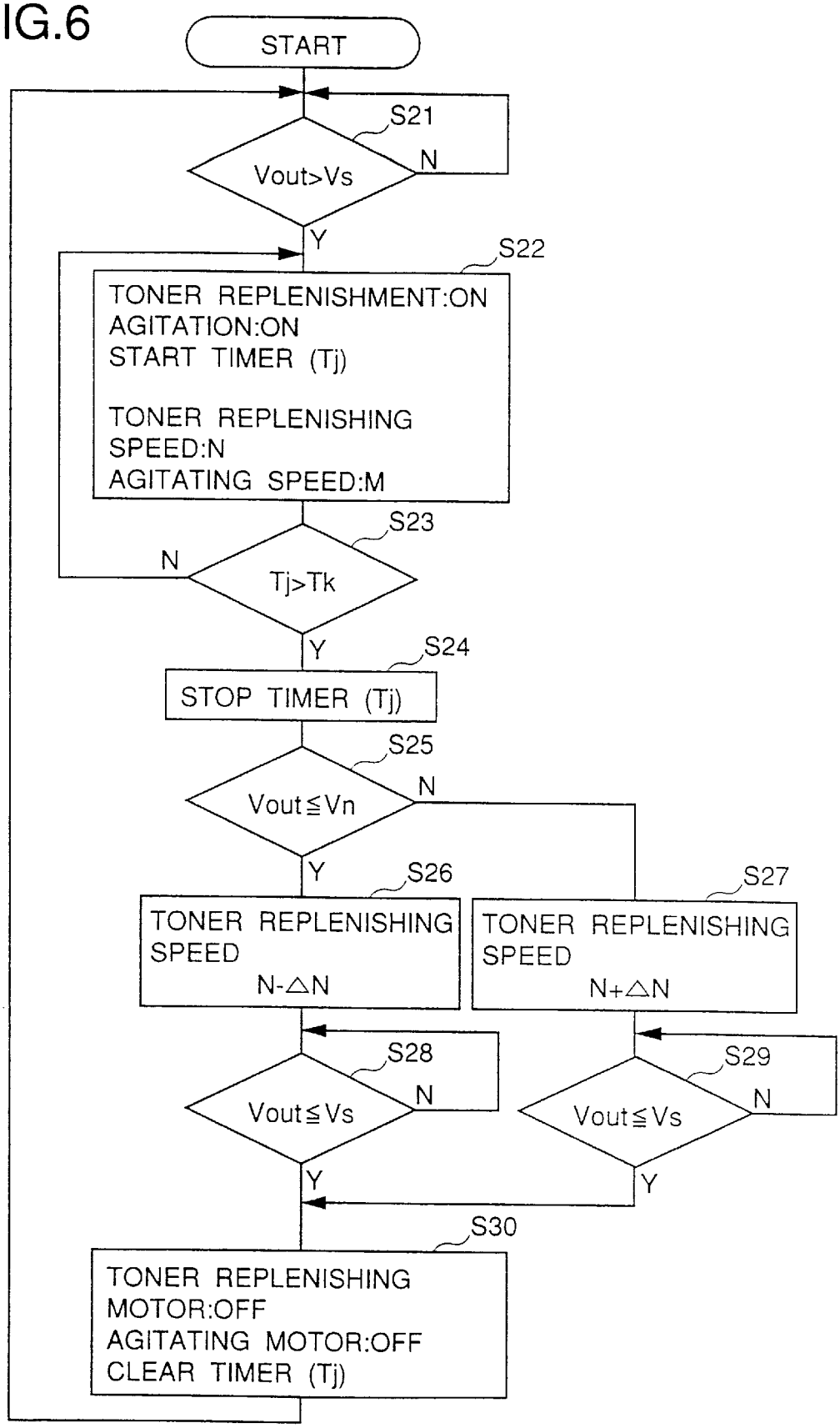
FIG. 6 is a flow chart showing a processing procedure of a second mode according to the present invention.

FIG. 6 is a flow chart showing a processing procedure when replenishing the toner according to a second mode of the present invention. The operation processing unit 14*b* compares the output Vout from the ATC sensor 4*c* with the reference value Vs stored in the storing unit 14*c* in carrying out an image forming process (s21) and starts replenishing the toner by driving the toner replenishing motor 4*h* and the agitating motor 4*j* respectively at the rotational speeds of N and M when the output Vout from the ATC sensor 4*c* is higher than the reference value Vs (s22). At this time, the clocking unit 14*a* clocks control time Tj which is a duration time period for replenishing control (s22) by using a built-in timer.

When the control time Tj clocked by the timer reaches a reference time Tk stored in the storing unit 14*c* (s23), the operation processing unit 14*b* stops the timer (s24) and compares the output Vout from the ATC sensor 4*c* at this time with an intermediate reference value Vn which is smaller than Vs (s25).

Figure 7A:
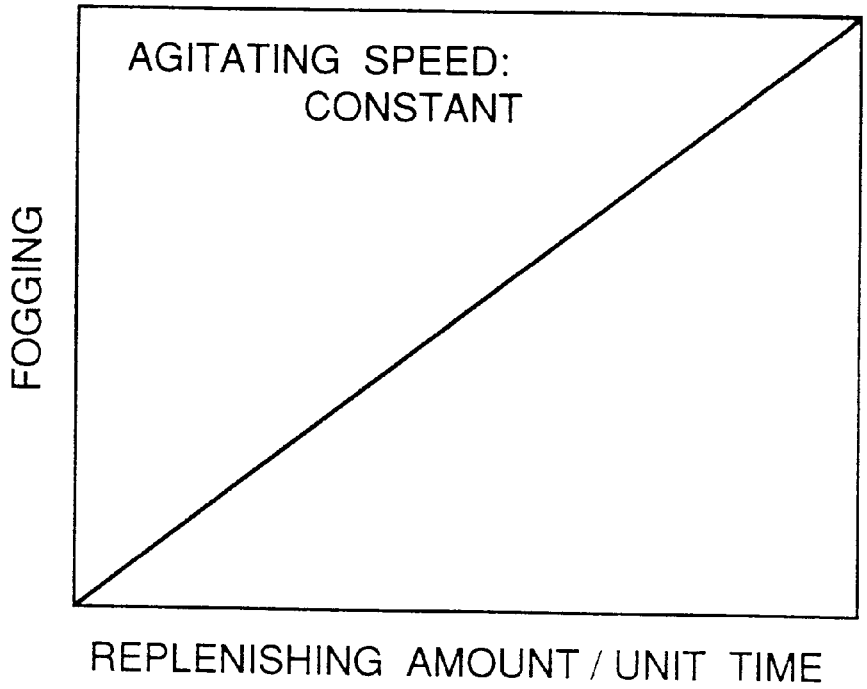
FIGS. 7(A) and 7(B) are diagrams for explaining the content of process control according to the second mode.

When the output Vout from the ATC sensor 4*c* is equal to or lower than the intermediate reference value Vn, it can be determined that an amount of the toner replenished to the developing agent tank 4*a* per unit time is relatively large, and when the output Vout from the ATC sensor 4*c* exceeds the intermediate reference value Vn, it can be determined that the amount of the toner replenished to the developing agent tank 4*a* per unit time is relatively small. As shown in FIG. 7(A), the amount of the toner replenished to the developing agent tank 4*a* influence, on the fogging state of image.

Therefore, in case that the output Vout from the ATC sensor 4*c* is equal to or lower than the intermediate reference value Vn when the output Vout from the ATC sensor 4*c* is compared with the intermediate reference value Vn, the operation processing unit 14*b* decreases the rotational speed N of the toner replenishing motor 4*h*, thereby decreasing the toner replenishing amount (s26). On the other hand, in case that the output Vout from the ATC sensor 4*c* is higher than the intermediate reference value Vn when the output Vout from the ATC sensor 4*c* is compared with the intermediate reference value Vn, the rotational speed of the toner replenishing motor 4*h* is increased, there by increasing the toner replenishing amount (s27).

Figure 7B:
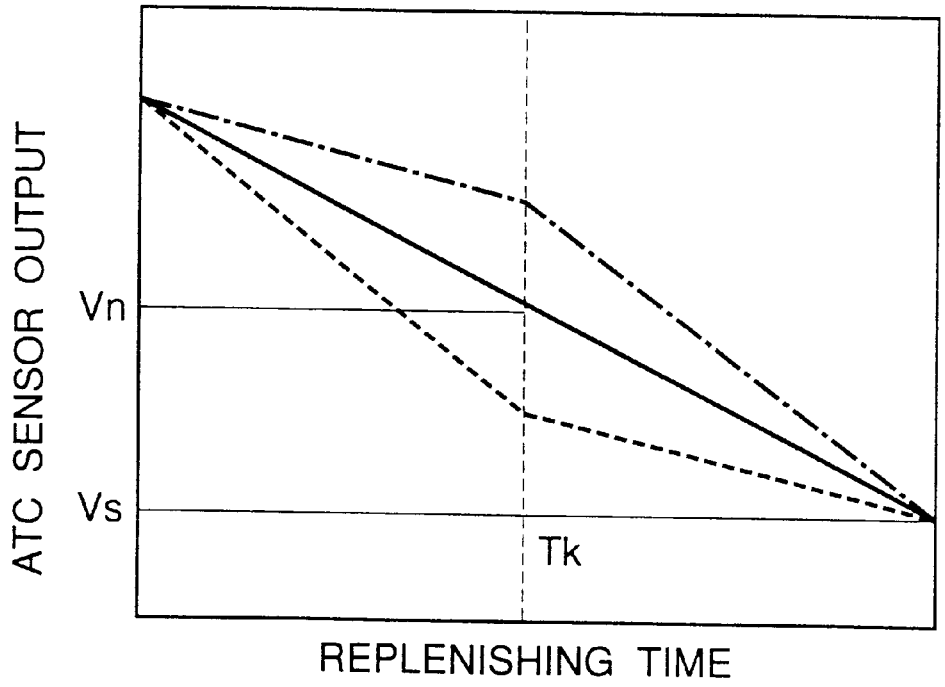

That is, as shown by a broken line in FIG. 7(B), in case that the output Vout from the ATC sensor 4*c* at the time point Tk is lower than the intermediate reference value Vn, the toner replenishing amount per unit time is decreased. On the other hand, as shown by a one-dotted chain line in FIG. 7(B), in case that the output Vout from the ATC sensor 4*c* at the time point Tk is higher than the intermediate reference value Vn, the toner replenishing amount per unit time is increased. Thereby, a time period for agitating the toner in the developing agent tank 4*a* can be made substantially constant regardless of a state of the toner such as fluidity or the like and a uniform charge state of the toner can always be obtained. Incidentally, when the output Vout becomes equal to or lower than the reference value Vs (s28, s29), the toner replenishing motor 4*h* and the agitating motor 4*j* are stopped and the timer is cleared (s30)

(Third Mode)

Figure 8:
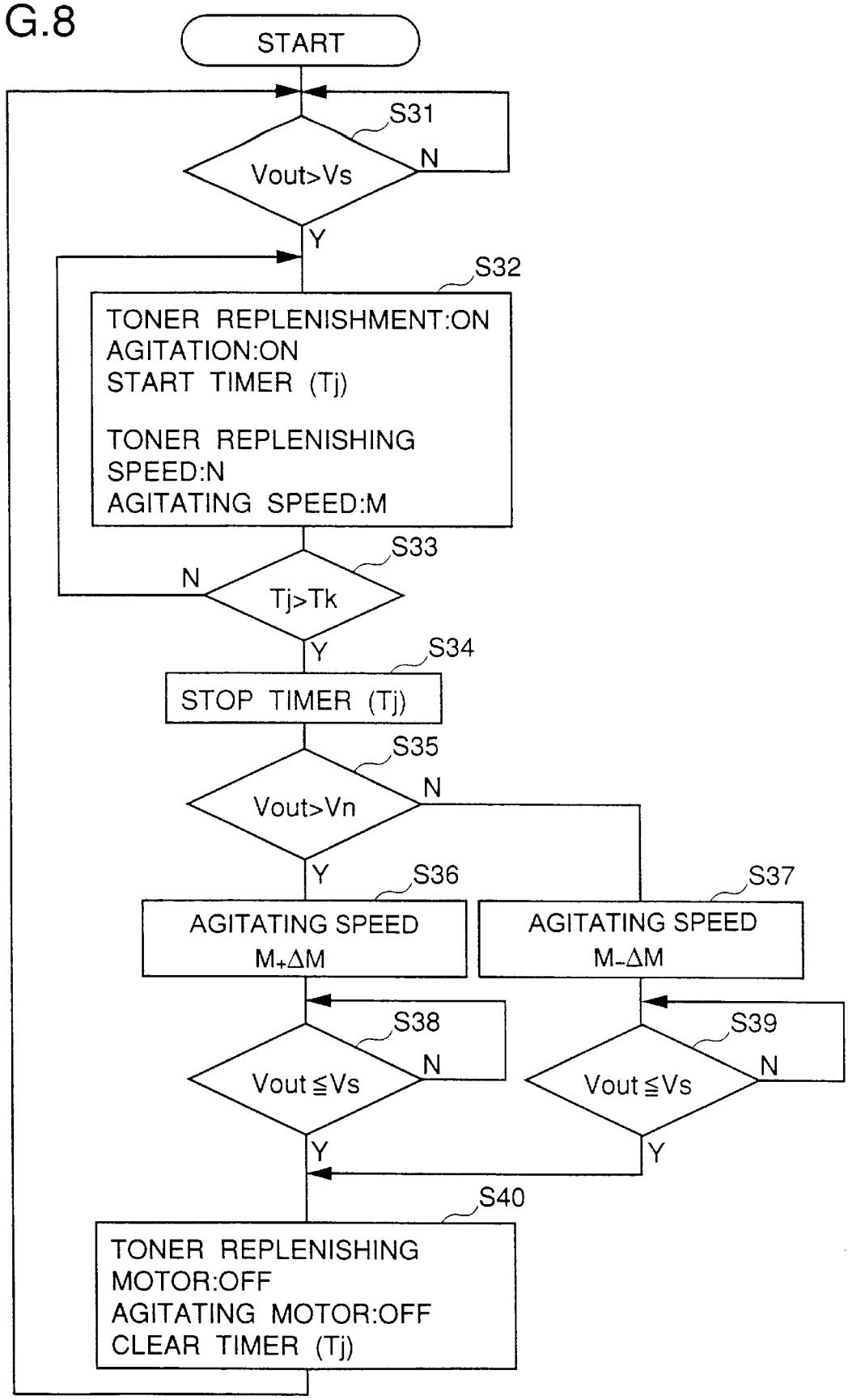
FIG. 8 is a flow chart showing a processing procedure of a third mode according to the present invention.

FIG. 8 is a flow chart showing a processing procedure when replenishing the toner according to a third mode of the present invention. The operation processing unit 14*b* compares the output Vout from the ATC sensor 4*c* with the reference value Vs in carrying out an image forming process (s31) and starts replenishing the toner by driving the toner replenishing motor 4*h* and the agitating motor 4*j* respectively at the rotational speeds N and M when the output Vout from the ATC sensor 4*c* is higher than the reference value Vs (s32). At this time, the clocking unit 14*a* clocks the control time Tj which is a duration time period for replenishing control by using a build-in timer (s32).

When the control time Tj clocked by the timer reaches the reference time Tk (s33), the operation processing unit 14*b* stops the timer (s34) and compares the output Vout from the ATC sensor 4*c* at this time with the intermediate reference value Vn (Vn>Vs) (s35)

Figure 9A:
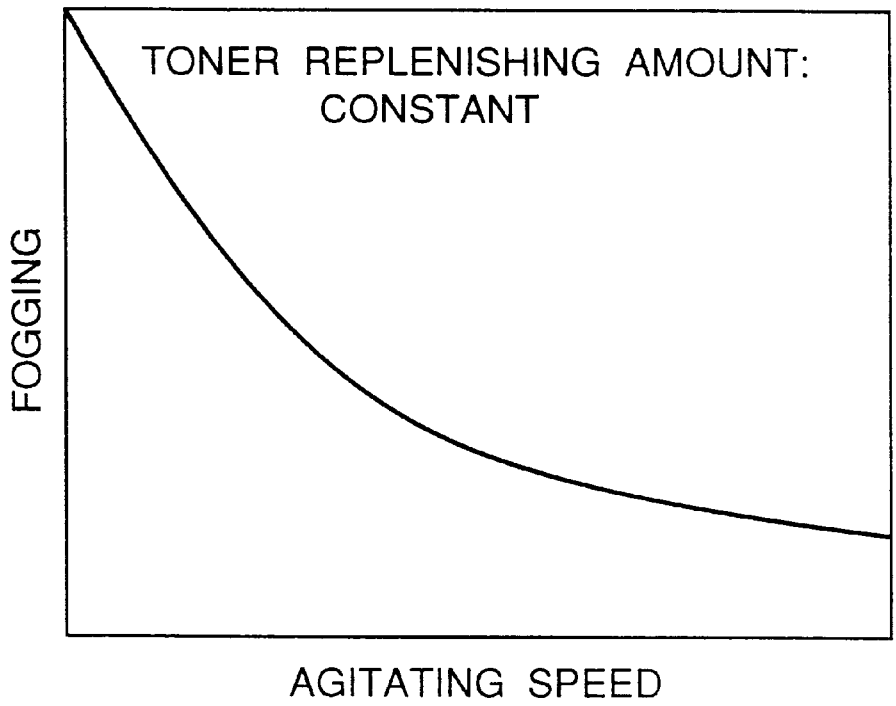
FIGS. 9(A) and 9(B) are diagrams for explaining the content of process control according to the third mode.

FIG. 9 (A) shows a relationship between an agitation speed and a fogging state of image when the toner has suitable fluidity, and indicates that when the agitation speed is increased, the charge amount of the toner is increased and fogging is reduced However, even when predetermined toner replenishing operation and agitating operation are carried out, deficiency in agitation is caused in case that the fluidity of the toner is low, so that the charge amount of the toner is deficient. In this case, the ATC sensor 4*c* also detects a low toner concentration. Therefore, when the output Vout from the ATC sensor 4*c* exceeds the intermediate reference value Vn, it can be determined that the fluidity of the toner is low and agitation is deficient, and when the output Vout from the ATC sensor 4*c* is equal to or lower than the intermediate reference value Vn, it can be determined that the fluidity of the toner is high and agitation is sufficiently carried out.

Accordingly, in case that the output Vout from the ATC sensor 4*c* is higher than the intermediate reference value Vn when the output Vout from the ATC sensor 4*c* is compared with the intermediate reference value Vn, the operation processing unit 14*b* determines that the fluidity of the toner is low and the charge amount of the toner is low, so that the rotational speed of the agitating roller 4*e* is increased by increasing the rotational speed of the agitating motor 4*j* (s36). On the other hand, when the output Vout from the ATC sensor 4*c* is equal to or lower than intermediate reference value Vn when the output Vout from the ATC sensor 4*c* is compared with the intermediate reference value Vn, the operation processing unit 14*b* determines that the fluidity of the toner is high and the charge amount of the toner is high, so that the rotational speed of the agitating roller 4*e* is decreased by decreasing the rotational speed EL of the agitating motor 4*j* (s37).

Figure 9B:
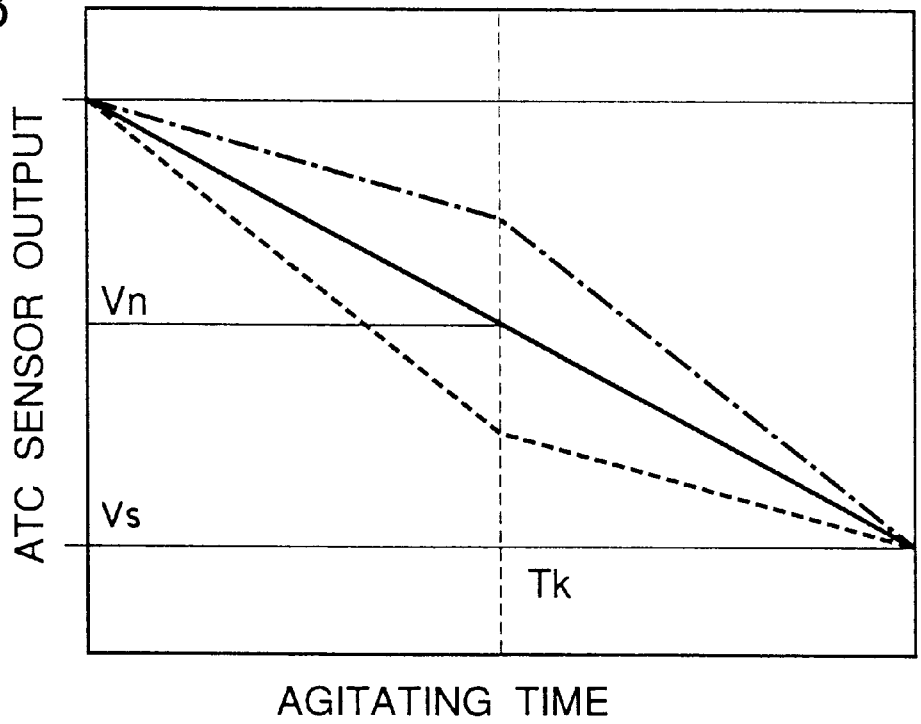

That is, as shown by a one-dotted chain line in FIG. 9(B), in case that the output Vout from the ATC sensor 4*c* at the time point Tk is higher than the intermediate reference value Vn, the rotational speed M of the agitating motor 4*j* is increased. On the other hand, as shown by a dotted line in FIG. 9(B), in case that the output Vout from the ATC sensor 4*c* at the time point Tk is equal to or lower than the intermediate reference value Vn, the rotational seed M of the agitating motor 4*j* is decreased. Thereby, the degree of agitating the toner in the developing agent tank 4*a* can be made substantially constant regardless of the state of the toner such as fluidity or the like and a uniform charge state of the toner can always be obtained. Incidentally, when the output Vout becomes equal to or lower than the reference value Vs (s38, s39), the toner replenishing motor 4*h* and the agitating motor 4*j* are stopped and the timer T is cleared (s40).

Further, when the developing bias voltage is controlled in the first mode, the grid voltage Vg applied to the grid 2*a* of the electrifying charger 2 by the surface potential control unit 13 may simultaneously be controlled. With control of only the developing bias voltage, the potential difference between the developing bias voltage and the grid voltage is decreased, thereby inducing a decrease in the image concentration. Therefore, by increasing or decreasing the grid voltage in compliance with an increase or a decrease in the developing bias voltage, not only fogging of image can be prevented but also the image concentration can be maintained.

Further, when the developing bias voltage in the first mode is negative polarity, an increase or a decrease in the developing bias voltage means an increase or a decrease in the absolute value of the developing bias voltage.

(Fourth Mode)

Figure 10:
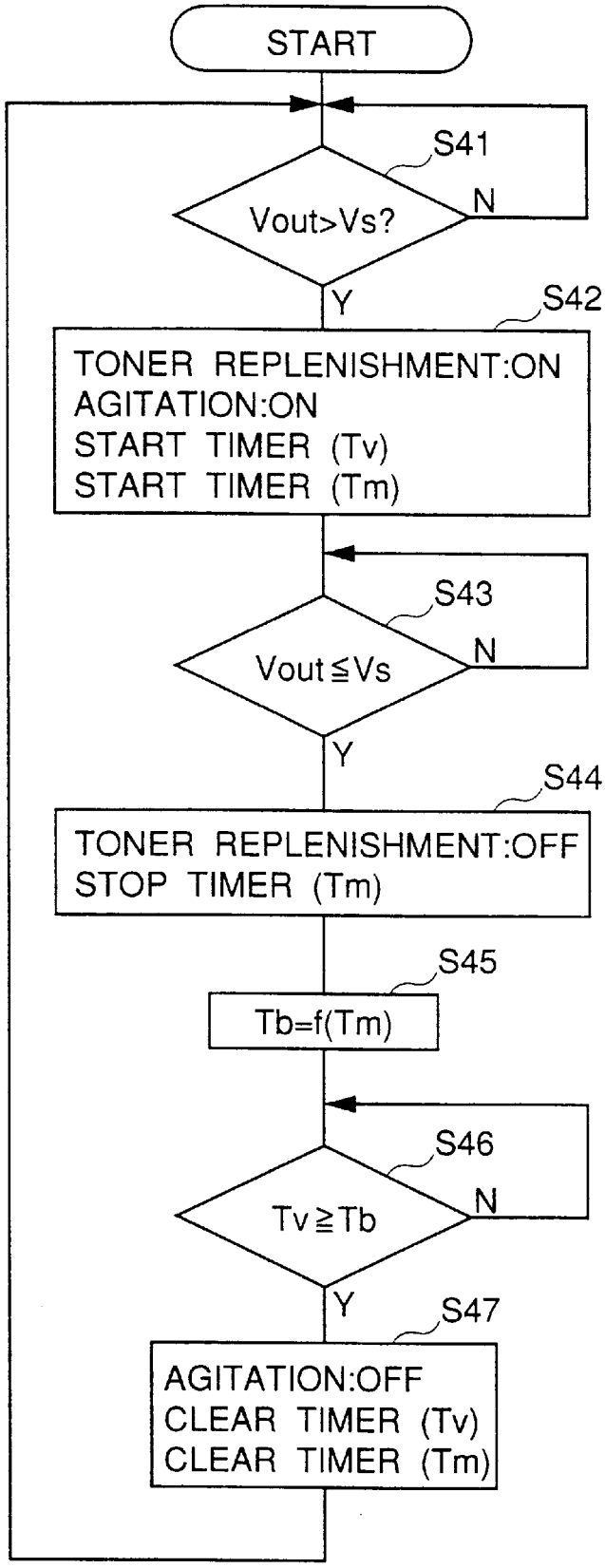
FIG. 10 is a flow chart showing a processing procedure of a fourth mode according to the present invention.

FIG. 10 is a flow chart showing a processing procedure in toner replenishing control according to a fourth mode of the present invention. The operation processing unit 14*b* compares the output Vout from the ATC sensor 4*c* with the reference value Vs in carrying out an image forming process (s41) and starts the toner replenishing control by driving the toner replenishing motor 4*h* and the agitating motor 4*j* when the output Vout from the ATC sensor 4*c* is higher than the reference value Vs (s42). At this time, the clocking unit 14*a* clocks an agitation duration time period Tv and a toner replenishment time period Tm by using a build-in timer (s42).

In carrying out the replenishing control, the operation processing unit 14 compares the output Vout from the ATC sensor 4*c* with the reference value Vs (s43), stops driving the toner replenishing motor 4*h* when the output Vout from the ATC sensor 4*c* becomes equal to or lower than the reference value Vs and stops clocking the replenishing time period Tm by the timer (s44). The operation processing unit 14*b* calculates an agitation duration time period Tb corresponding to the toner replenishing time period Tm on the basis of a predetermined function Tb=f(Tm) as shown in FIG. 11 (s45).

The operation processing unit 14*b* compares the agitation time period Tv clocked by the timer with the calculated time period Tb(s46), continues driving the agitating motor 4*j* until the agitation time period Tv coincides with the time period Tb and stops the agitating motor 4*j* and clears the respective timers (s47) when the time period Tv becomes equal to or longer than the time per od Tb (s46).

Figure 11:
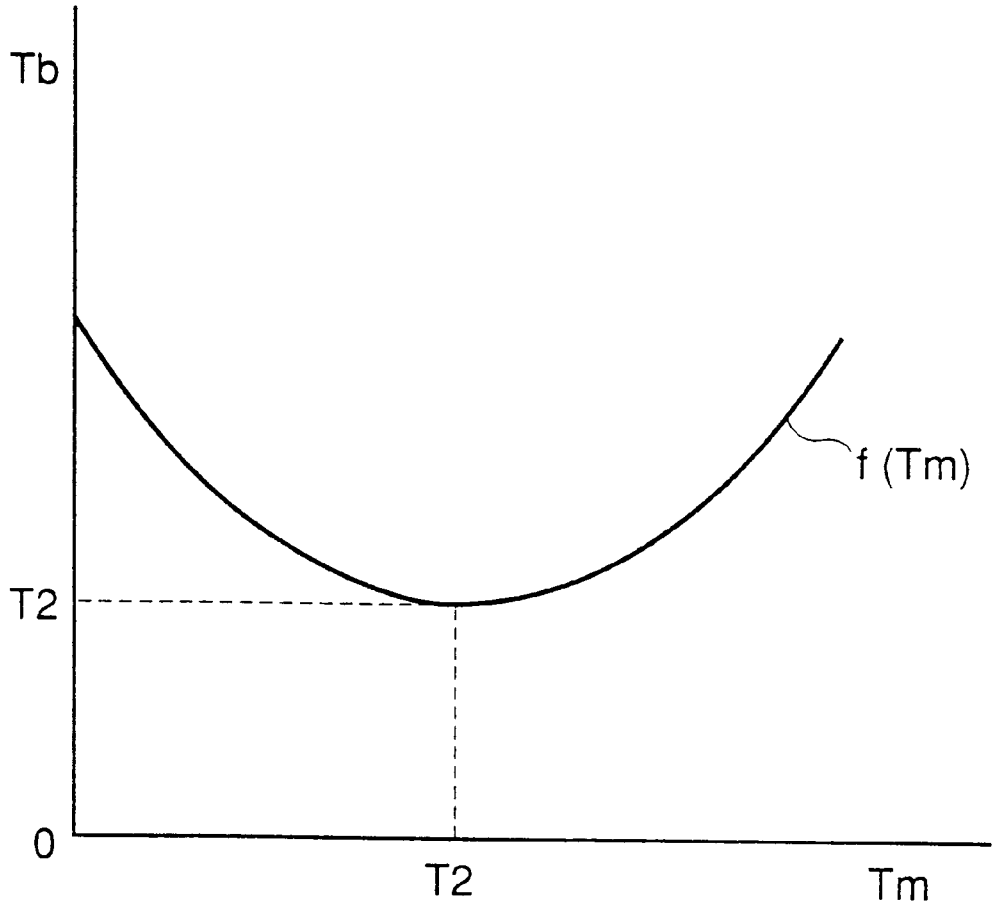
FIG. 11 is a diagram for explaining the content of process control according to the fourth mode.

The function Tb=f(Tm) is a function in which Tb becomes a minimum value T2 when Tm=T2 as shown in FIG. 11.

When the toner replenishing time period Tm coincides with the predetermined time period T2, the operation processing unit 14*b* determines that the fluidity of the toner is optimum and the agitation is carried out appropriately and finishes the agitating motion simultaneously with finishing the replenishment of the toner.

When the toner replenishing time period Tm is shorter than the predetermined time period T2, the operation processing unit 14*b* determines that the agitation is not sufficient since the fluidity of the toner is high and the amount of replenishing the toner per unit time is large and prolongs the agitation time period based on the function Tb=f(Tm).

Further, where. the toner replenishing time period Tm is longer than the predetermined time period T2, the operation processing unit 14*b* determines that the toner is lump-like, the fluidity is low and the agitation is not sufficient and prolongs the agitation time period based on the function Tb=f(Tm).

In this way, the charge performance of the toner can be brought into a proper state and fogging of image can be prevented by prolonging relatively the agitation time period in respect of the toner amount in the developing agent tank 4*a*.

According to the present invention, even when the fluidity of the toner is varied, fogging of image can firmly be prevented by controlling the image forming process conditions and conditions of agitating the developing agent based on the toner replenishing time period for recovering the toner concentration of the developing agent to the reference value.

What is claimed is:

1. An image forming device for forming an image on a medium, comprising:

an optical system for forming an electrostatic latent image on a photosensitive body by exposure an original in light;

a development system for developing the electrostatic latent image; and a control system for controlling the optical system and the development system;

wherein the development system includes a developing agent tank for storing a two components developing agent comprising a toner and a carrier, a replenishing unit for replenishing the toner to the developing agent tank, an agitating unit for mixing the two components developing agent in the developing agent tank and a developer for permitting the toner included in the developing agent in the developing agent tank to adhere to the photosensitive body; and the control system includes a detecting unit for detecting a concentration of the toner in the developing agent tank, a storing unit for storing a predetermined toner concentration, an operation processing unit for calculating a difference between the detected concentration and the predetermined toner concentration and for operating the replenishing unit until the detected concentration makes a recovery to the predetermined toner concentration when the detected concentration becomes smaller than the predetermined toner concentration, a clocking unit for clocking a time period for the recovery and a control unit for controlling a state of the formed image by adjusting at least one of the amount of the light exposing the original and the amount of the toner adhering to the photosensitive body based on the clocked time period for the recovery.

2. The image forming device according to claim 1, wherein the optical system includes a lamp for exposing the original with light, the control system further includes a copying lamp control unit for applying a drive voltage to the lamp and the control unit adjusts the amount of the exposure light by varying the drive voltage applied to the lamp through the copying lamp control unit.

3. The image forming device according to claim 1, wherein the developer includes a developing roller for permitting the toner to adhere to the photosensitive body, the control system further includes a developer control unit for applying a bias voltage to the developing roller and the control unit adjusts the amount of the toner adhering to the photosensitive body by varying the bias voltage by the developer control unit.

4. An image forming device comprising:

an optical system for forming an electrostatic latent image on a photosensitive body by exposure of an original in light;

a development system for developing the electrostatic latent image;

a control system for controlling the optical system and the development system;

wherein the development system includes a developing agent tank for storing a two components developing agent comprising a toner and a carrier, a replenishing unit for replenishing the toner to the developing agent tank, an agitating unit for mixing the two components developing agent in the developing agent tank, a developer for permitting the toner included in the developing agent in the developing agent tank to adhere to the photosensitive body, and first and second driving sources for operating the replenishing and agitating units, respectively; and wherein the control system includes a detecting unit for detecting a concentration of the toner in the developing agent tank, a storing unit for previously storing a first toner concentration and a second toner concentration lower than the first toner concentration, an operation processing unit for calculating a difference between the detected concentration and the first toner concentration and for operating the replenishing unit and the agitating unit until the detected concentration recovers to the first toner concentration when the detected concentration becomes smaller than the first toner concentration, a clocking unit for clocking a predetermined time period following commencement of operation of the replenishing and agitating units and a control unit for individually controlling a replenishing speed of the replenishing unit and an agitating speed of the agitating unit based on the difference between toner concentration detected by the detecting unit at the end of the predetermined time period and the second toner concentration, until the detected concentration recovers further to the first toner concentration.

5. The image forming device according to claim 4, wherein the replenishing unit includes a hopper installed above the developing agent tank for storing the toner and a toner replenishing roller rotatably installed between the hopper and the developing agent tank for replenishing the toner form the hopper to the developing agent tank, the control system further includes a developer control unit for driving a toner replenishing roller and the control unit controls the replenishing speed of the replenishing unit by varying a rotating speed of the toner replenishing roller by the developer control unit.

6. The image forming device according to claim 4, wherein the agitating unit includes an agitating roller rotatably installed in the developing agent tank, the control system further includes a developer control unit for driving an agitating roller and the control unit controls an agitating speed of the agitating unit by varying a speed of rotating the agitating roller by the developer control unit.

7. An image forming device comprising:

an optical system for forming an electrostatic latent image on a photosensitive body by exposure of an original in light;

a development system for developing the electrostatic latent image;

a control system for controlling the optical system and the development system;

wherein the development system includes a developing agent tank for storing a two components developing agent comprising a toner and a carrier, a replenishing unit for replenishing the toner to the developing agent tank, an agitating unit for mixing the two components developing agent in the developing agent tank and a developer for permitting the toner included in the developing agent in the developing agent tank to adhere to the photosensitive body;

wherein the control system includes a detecting unit for detecting a concentration of the toner in the developing agent tank, a storing unit for storing a predetermined toner concentration, an operation processing unit for calculating a difference between the detected concentration and the predetermined toner concentration and for operating the replenishing unit and the agitating unit until the detected concentration makes a recovery to the predetermined toner concentration when the detected concentration becomes smaller than the predetermined toner concentration, a clocking unit for clocking a time period for the recovery and a control unit for calculating an additional time period corresponding to the time period for the recovery and for further operating the agitating unit by the additional time period after the detected concentration has recovered to the predetermined concentration; and wherein the control unit calculates the additional time period based on a function of an additional agitating time period in respect of a time period until the detected concentration recovers to the predetermined toner concentration.

* * * * *